US011732876B2

(12) United States Patent
Qiao et al.

(10) Patent No.: US 11,732,876 B2
(45) Date of Patent: Aug. 22, 2023

(54) CEILING LAMP AND CHASSIS

(71) Applicants: SUZHOU OPPLE LIGHTING CO., LTD., Suzhou (CN); OPPLE LIGHTING CO., LTD., Shanghai (CN)

(72) Inventors: Shengjie Qiao, Suzhou (CN); Hongwei Chen, Suzhou (CN); Guoquan Li, Suzhou (CN); Zhanhua Chen, Suzhou (CN); Guobao Zhang, Suzhou (CN); Guolong Ni, Suzhou (CN)

(73) Assignees: Suzhou Opple Lighting Co., Ltd., Suzhou (CN); Opple Lighting Co., Ltd., Shanghai (CN)

( * ) Notice: Subject to any disclaimer, the term of this patent is extended or adjusted under 35 U.S.C. 154(b) by 37 days.

(21) Appl. No.: 17/475,326

(22) Filed: Sep. 14, 2021

(65) Prior Publication Data

US 2022/0003390 A1 Jan. 6, 2022

Related U.S. Application Data

(63) Continuation of application No. PCT/CN2020/079987, filed on Mar. 18, 2020.

(51) Int. Cl.
*F21V 21/03* (2006.01)
*F21S 8/04* (2006.01)
*F21V 17/16* (2006.01)

(52) U.S. Cl.
CPC ..... *F21V 21/03* (2013.01); *F21S 8/04* (2013.01); *F21V 17/16* (2013.01)

(58) Field of Classification Search
CPC ... F21V 21/03; F21V 17/16; F21S 8/04; F21S 8/03

(Continued)

(56) References Cited

U.S. PATENT DOCUMENTS

2002/0136013 A1* 9/2002 Crunk ..... F21V 19/005 362/310
2014/0016319 A1* 1/2014 Wendler ..... F21V 23/06 29/830
2016/0348860 A1 12/2016 Bailey

FOREIGN PATENT DOCUMENTS

CN 103604075 A 2/2014
CN 104197253 A 12/2014

(Continued)

OTHER PUBLICATIONS

International Search Report of PCT Application No. PCT/CN2020/079987 dated Jun. 11, 2020 with English translation, (6p).

*Primary Examiner* — Laura K Tso
(74) *Attorney, Agent, or Firm* — Arch & Lake LLP

(57) ABSTRACT

A ceiling lamp and a chassis are provided. The ceiling lamp includes a chassis and a light source module; the chassis includes a surrounding wall and a partition disposed within the surrounding wall, the partition divides a region surrounded by the surrounding wall into an assembly recess with a downward opening and a wiring recess with an upward opening; part of the partition protrudes upwardly into the wiring recess and forms a light source recess with a downward opening and an upward recess bottom, and the light source module is provided in the light source recess. The chassis includes a surrounding wall and a partition disposed within the surrounding wall, the partition divides a region surrounded by the surrounding wall into an assembly recess with a downward opening and a wiring recess with an upwardly opening.

20 Claims, 7 Drawing Sheets

(58) Field of Classification Search
USPC ..... 362/396, 362, 147, 221
See application file for complete search history.

(56) References Cited

FOREIGN PATENT DOCUMENTS

| | | | | |
|---|---|---|---|---|
| CN | 106678632 | A | | 5/2017 |
| CN | 209325597 | U | | 8/2019 |
| GB | 2562195 | | * | 7/2019 |
| JP | 2011134684 | A | | 7/2011 |
| JP | 2013179093 | A | | 9/2013 |
| JP | 2013243163 | A | | 12/2013 |
| JP | 2014029870 | A | | 2/2014 |
| JP | 2014029871 | A | | 2/2014 |
| JP | 2014130848 | A | | 7/2014 |
| JP | 2015181130 | A | | 10/2015 |
| JP | 2017076634 | A | | 4/2017 |
| JP | 2017117808 | A | | 6/2017 |
| JP | 2017117809 | A | | 6/2017 |
| JP | 2017117810 | A | | 6/2017 |
| JP | 2018010879 | A | | 1/2018 |

* cited by examiner

CEILING LAMP AND CHASSIS

CROSS REFERENCE

This application is based upon and claims the priority of PCT patent application No. PCT/CN2020/079987 filed on Mar. 18, 2020 which claims priority of Chinese Patent Application No. 201920339055.3 filed on Mar. 18, 2019, the entire disclosures of these applications are incorporated herein by reference in their entirety for all purposes.

TECHNICAL FIELD

The present disclosure relates to the field of lighting, and in particular, to a ceiling lamp and a chassis.

BACKGROUND

With the development of society, lamps have become essential electrical appliances in people's lives and in the production. There are many lamp types currently on the market, such as ceiling lamps, chandeliers, track lights, down lamps, wall lamps and the like, and each type of lamp has different characteristics, so that users can choose them according to needs.

SUMMARY

The present disclosure provides a ceiling lamp and a chassis.

On a first aspect, examples of the present disclosure provide a ceiling lamp, which comprises a chassis and a light source module. The chassis may include a surrounding wall and a partition disposed within the surrounding wall, the partition divides a region surrounded by the surrounding wall into an assembly recess with a downward opening and a wiring recess with an upward opening. Part of the partition may protrude upwardly into the wiring recess and may form a light source recess with a downward opening and an upward recess bottom, and the light source module is provided in the light source recess.

On a second aspect, examples of the present disclosure provide a chassis, which may include a surrounding wall and a partition disposed within the surrounding wall, where the partition may divide a region surrounded by the surrounding wall into an assembly recess with a downward opening and a wiring recess with an upwardly opening; and part of the partition may protrude upwardly into the wiring recess and may form a light source recess with a downward opening and an upward recess bottom.

It is to be understood that both the foregoing general description and the following detailed description are exemplary and explanatory only and are not restrictive of the present disclosure.

BRIEF DESCRIPTION OF THE DRAWINGS

The drawings described herein are intended for a further understanding of the present disclosure and constitute a part of the present disclosure. Examples of the present disclosure and descriptions thereof are intended to explain the present disclosure, and do not constitute any inappropriate limitation on the present disclosure.

DETAILED DESCRIPTION

Figure 1:
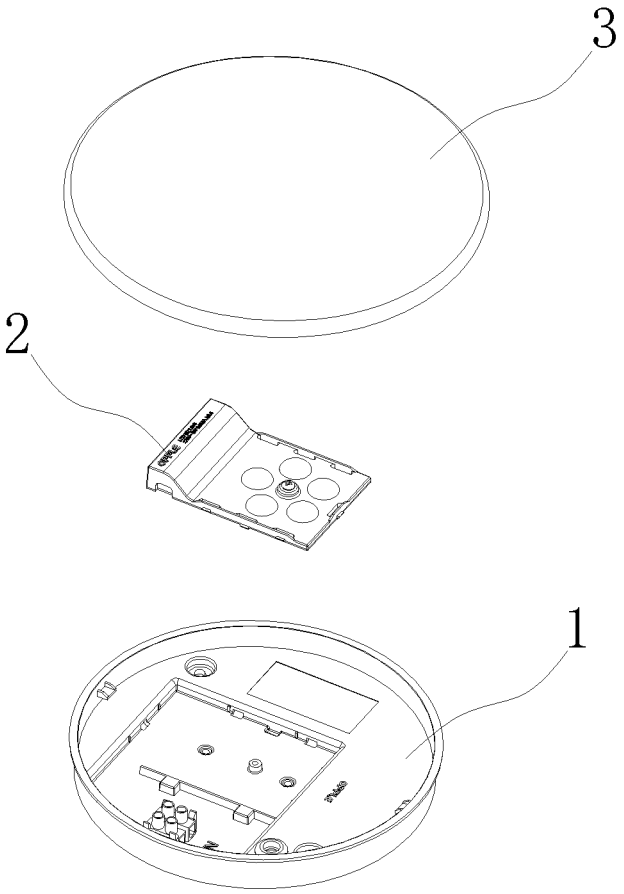
FIG. 1 is an exploded structural view of a first ceiling lamp provided by an example of the present disclosure.

In order to make the purpose, technical solutions, and advantages of the present disclosure clearer, the technical solutions of the present disclosure will be described below in conjunction with examples of the present disclosure and the corresponding drawings. The described examples are only a part of the examples of the present disclosure, rather than all the examples. Based on the examples in the present disclosure, all other examples obtained by those of ordinary skill in the art without creative work shall fall within the protection scope of the present disclosure.

Reference numerals in this disclosure may include:

1-chassis, 10-surrounding wall, 100-assembly recess, 101-wiring recess, 11-partition, 110-light source recess, 110*a*-light source setting region, 110*b*-electrical component setting region, 1100-recess bottom, 1101-clamping hole, 1102-recess wall, 1103-partition wall, 1104-reinforcing block, 1105-positioning post avoidance region, 1106-second buckle avoidance region, 1107-auxiliary mounting post, 1107*a*-first threaded hole, 1108-connecting notch, 1108*a*-second threaded hole, 2-light source module, 20-substrate, 200-positioning hole, 201-second through hole, 21-light emitting unit, 22-drive unit, 23-light distribution element, 230-first buckle, 231-second buckle, 232-positioning post, 233-boss, 2330-first through hole, 24-light source receiving cavity, 240-light distribution structure, 25-drive receiving cavity, 26-first screw, 27-auxiliary drive receiving cavity, 28-connecting lug, 280-connection hole, 29-second screw, 3-cover, and 4-electrical component.

As a common indoor lighting device, the ceiling lamp generally has a flat configuration, and has characteristics such as a small height occupation, a wide range of lighting, and the like. However, the overall thickness of the ceiling lamp sometimes is still large, resulting in an increase in the size of the product, thereby increasing packaging and inventory costs.

Examples of the present disclosure provides a ceiling lamp, as shown in FIG. 1 to FIG. 8, the ceiling lamp includes a chassis 1 and a light source module 2, and usually may also include a cover 3. The chassis 1 is a basic structure of the ceiling lamp, and is used to integrally fix the ceiling lamp to a ceiling. The light source module 2 is a light emitting structure of the ceiling lamp, and is fixed on the chassis 1. The cover 3 is usually a transparent or translucent shield assembled to the chassis 1, and is used for protecting the light source module 2 and serving as a main appearance structure of the ceiling lamp.

Figure 2:
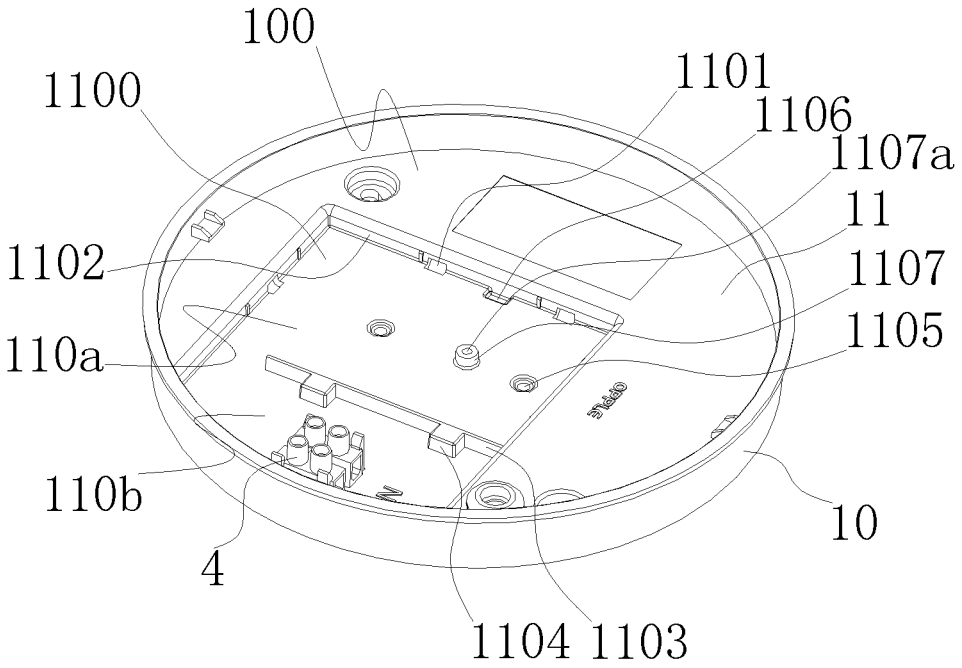
FIG. 2 is a three-dimensional view of a chassis of a first ceiling lamp provided by an example of the present disclosure, observed from one side of an assembly recess.
Figure 3:
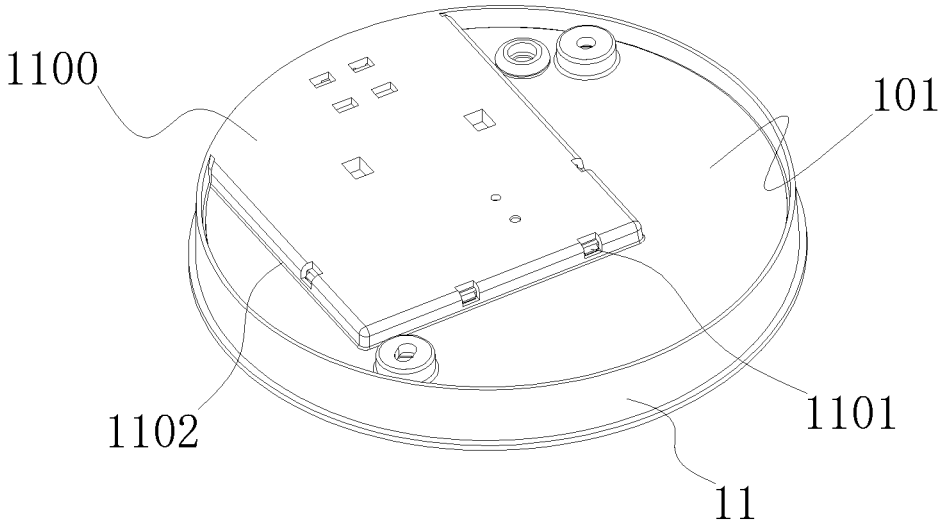
FIG. 3 is a three-dimensional view of a chassis of a first ceiling lamp provided by an example of the present disclosure, observed from one side of a wiring recess.

Specifically, as shown in FIG. 2 and FIG. 3, the chassis 1 in this example includes a surrounding wall 10 and a partition 11 disposed inside the surrounding wall 10, the surrounding wall 10 surrounds a vertically open and peripherally-enclosed space, and a contour of the surrounding wall 10 is generally circular in shape, but may also be triangular, square, rectangular or in other common shapes. The partition 11 is substantially parallel with a horizontal plane and divides a region surrounded by the surrounding wall 10 into an assembly recess 100 with a downward opening and a wiring recess 101 with an upward opening. The assembly recess 100 is used for assembling other components of the ceiling lamp, and the wiring recess 101 is mainly used to hold extra power wires.

Sometimes, the light source module may be disposed directly in an assembly recess, and the assembly recess may be covered by a cover. In order to be able to receive the light source module, the assembly recess needs to have a sufficient thickness, or the middle of the cover protrudes out significantly. All the foregoing means lead to that the assembly recess with a greater thickness is required for the ceiling lamp to receive the light source module, resulting in an increased overall thickness of the ceiling lamp.

Referring to FIG. 2, in this example, part of the partition 11 protrudes upwardly into the wiring recess 101 to form a light source recess 110 with a downward opening, and the light source module 2 is disposed in the light source recess 110. In this way, the light source module 2 may use part of the space of the wiring recess 101. In the case where the thickness of the assembly recess 100 is constant, the total thickness of a region for receiving the light source module 2 is a sum of the thickness of the light source recess 110 and the thickness of the assembly recess 100. Therefore, both the thickness of the assembly recess 100 itself and a protruding extent of the cover 3 can be reduced, thereby reducing the overall thickness of the ceiling lamp. In some examples, the cover 3 may be even of a nearly flat structure covering the assembly recess 100.

As shown in FIG. 3, the light source recess 110 in this example has a recess bottom 1100, and a surface of one side of the assembly recess 1100 away from the assembly recess 100 may be maintained flush with an edge of the wiring recess 101, i.e., when the edge of the wiring recess 101 contacts a ceiling, the recess bottom 1100 also contacts the ceiling. This enables heat produced by the light source module 2 to be transmitted through the recess bottom 1100 more quickly to the ceiling, thereby improving a heat dissipation effect.

The light source recess 110 and the light source module 2 in this example may be connected through various detachable or non-detachable connection methods (detaching may cause structural damage), where a detachable connection method such as a clamping connection or a magnetic attraction is preferably used. Specifically, as shown in FIG. 2 and FIG. 3, a clamping hole 1101 may be provided in the light source recess 110, a first buckle 230 corresponding to the clamping hole 1101 is arranged on the light source module 2, the light source module 2 and the light source recess 110 are connected through a clamping connection between the first buckle 230 and the clamping hole 1101. A magnet and an attractable object attractable by the magnet may also be arranged between the light source recess 110 and the light source module 2, thereby achieving the connection of the light source module 2 and the light source recess 110. Alternatively, a connecting lug 28 may be arranged at an edge of the light source module 2, and a connection hole 280 is arranged on the connecting lug, a connecting notch 1108 fitting the connecting lug is formed on an edge of the light source recess 110, and a second threaded hole 1108*a* corresponding to the connection hole 280 is arranged on the connecting notch 1108, and a fixed connection is achieved through a second screws 29 (referring to FIG. 6). All the above examples are detachable methods. In this example, the connection between the light source module 2 and the light source recess 110 may also be a non-detachable method, which includes but is not limited to adhesion, welding and the like.

Figure 4:
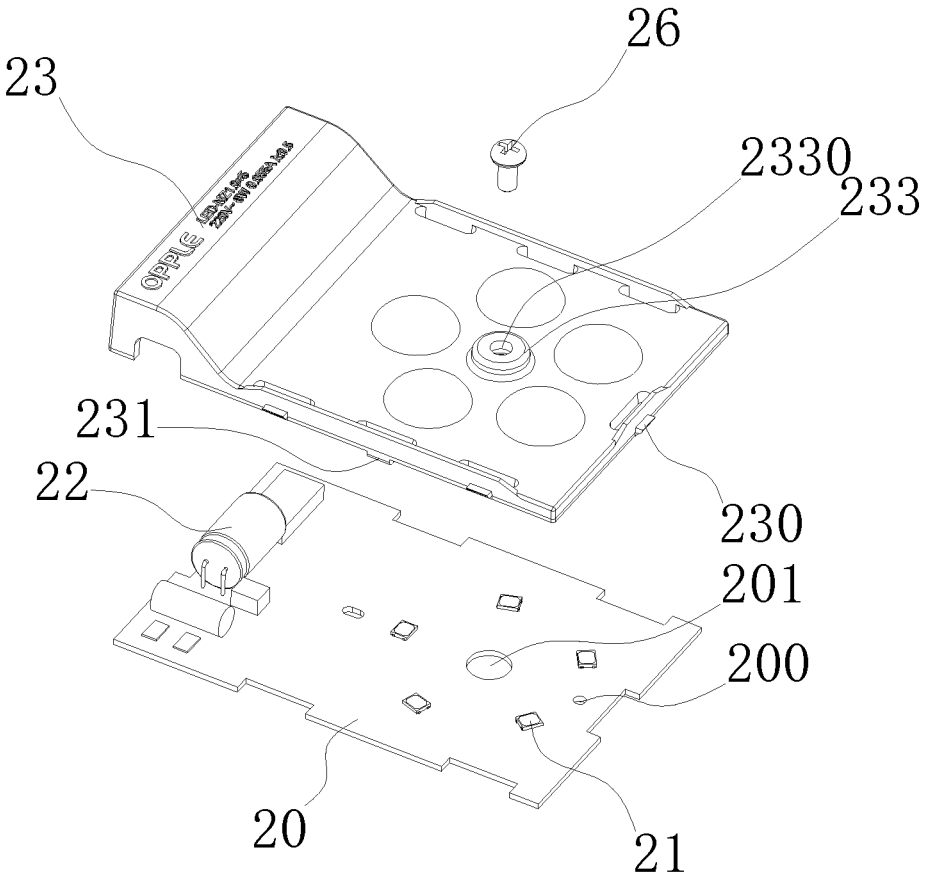
FIG. 4 is an exploded structural view of a light source module of a first ceiling lamp provided by an example of the present disclosure.
Figure 5:
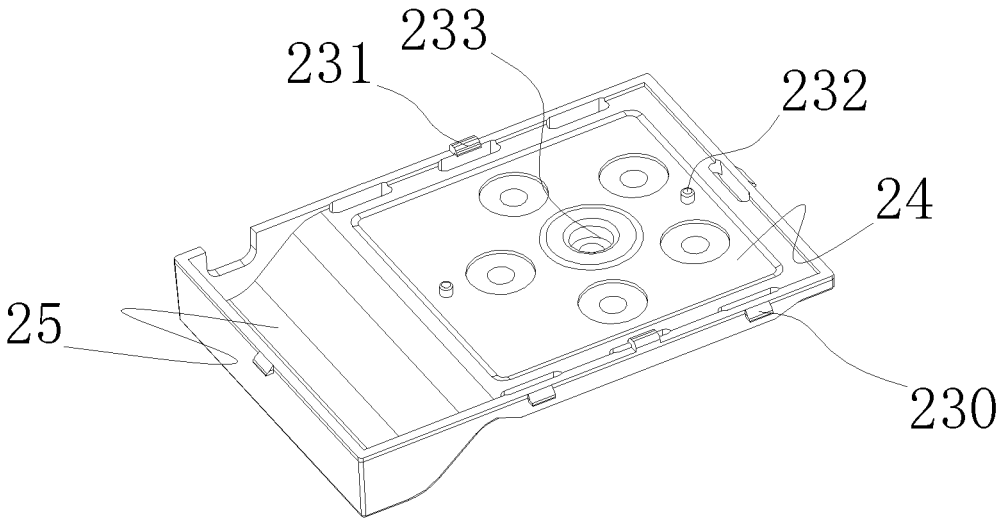
FIG. 5 is a structural view of a light distribution element of a first ceiling lamp provided by an example of the present disclosure.
Figure 6:
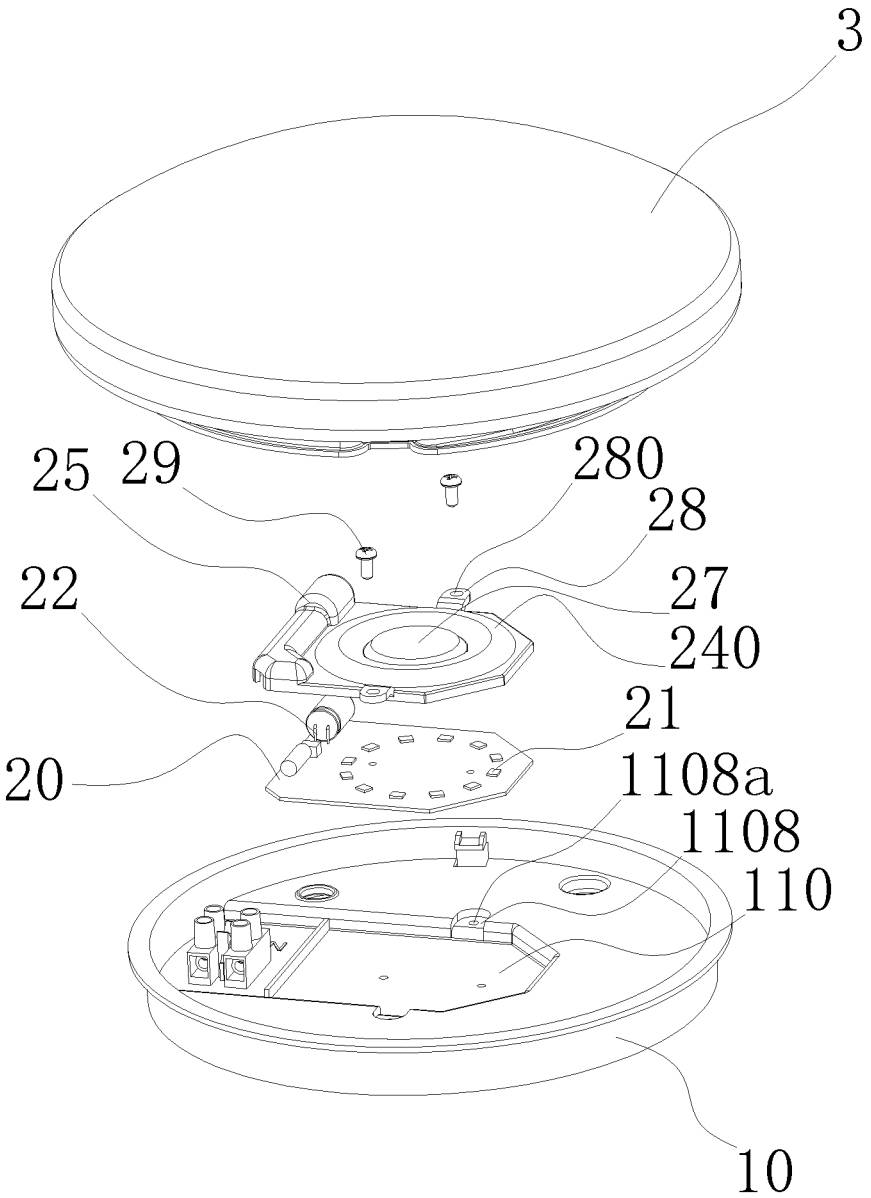
FIG. 6 is an exploded structural view of a second ceiling lamp provided by an example of the present disclosure.
Figure 7:
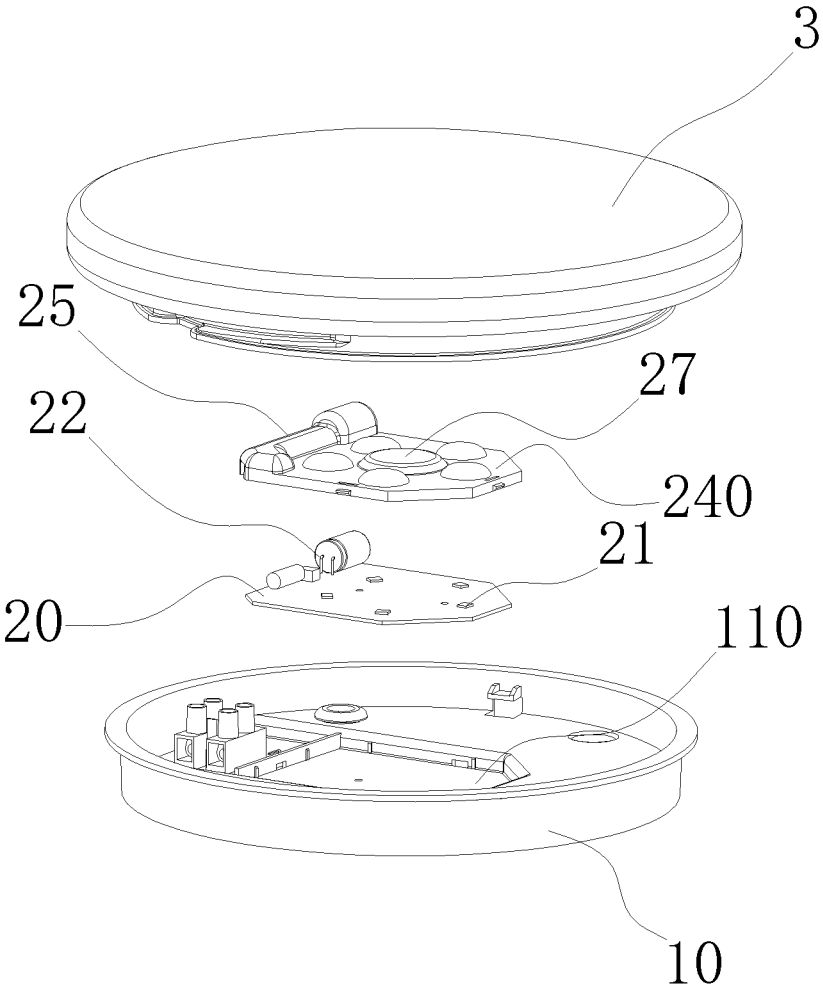
FIG. 7 is an exploded structural view of a third ceiling lamp provided by an example of the present disclosure.
Figure 8:
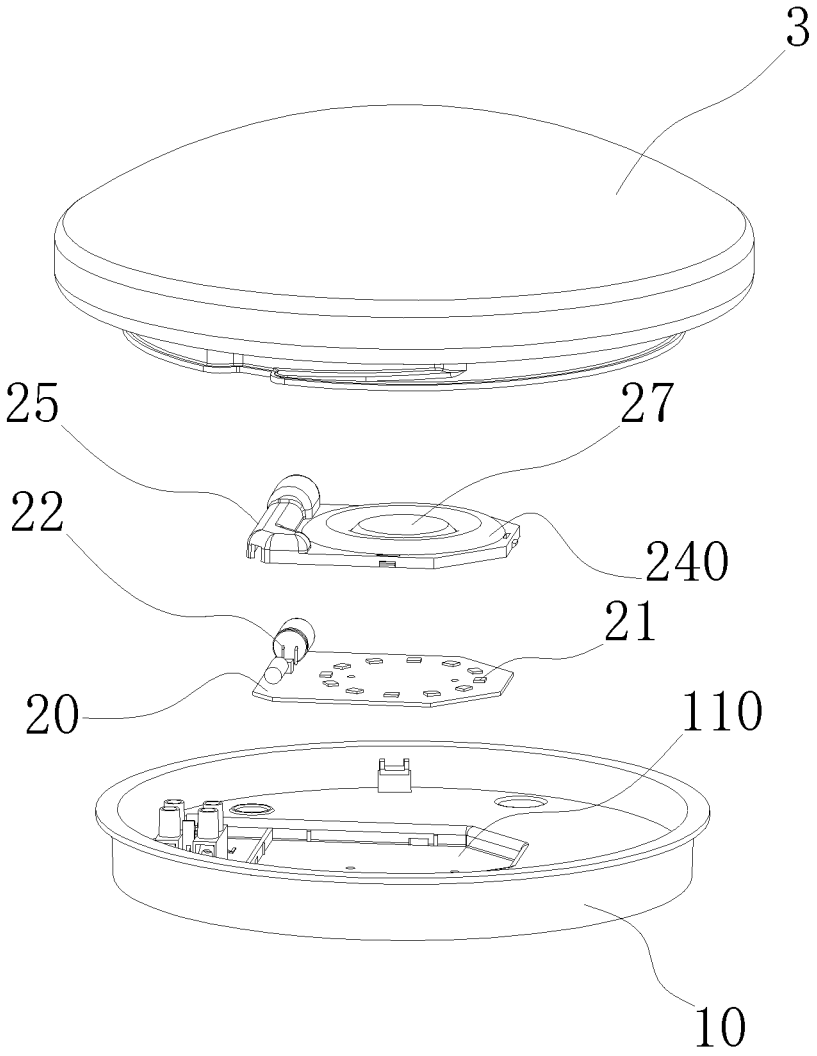
FIG. 8 is an exploded structural view of a fourth ceiling lamp provided by an example of the present disclosure.

As shown in FIG. 4 and FIG. 5, in this example, the light source module 2 includes a substrate 20, a light emitting unit 21, a drive unit 22, and a light distribution element 23. The light distribution element 23 is provided on the substrate 20 and covers the substrate 20, and the light distribution element 23 and the substrate 20 jointly surround to form a light source receiving cavity 24 and a drive receiving cavity 25. Since the substrate 20 is of a substantially plate-like structure, the light source receiving cavity 24 and the drive receiving cavity 25 substantially each form a chamber by recessing of the light distribution element 23, and the openings of the chambers is blocked/packaged by the substrate 20. The substrate 20 and the light distribution element 23 may be connected through a clamping connection and the like, for example, a second buckle 231 may be arranged on the light distribution element 23 to clamp the substrate 20.

The light emitting unit 21 is disposed on the substrate 20, and the light emitting unit 21 is located in the light source receiving cavity 24. A light distribution structure 240 may be arranged in the light source receiving cavity 24, a configuration of the light distribution structure 240 may be selected as a rotary light distribution structure (referring to a first ceiling clamp shown in FIG. 1, FIG. 4 and FIG. 5, and a third ceiling lamp shown in FIG. 7) as required, or selected as a stretch light distribution structure (referring to a second ceiling lamp shown in FIG. 6 and a fourth ceiling lamp shown in FIG. 8). The drive unit 22 is also disposed on the substrate 20, and in the drive receiving cavity 25. The buckle 230 may be disposed on the light distribution element 23, so that a clamping structure of the entire light source module 2 and the light source recess 110 is achieved by a clamping connection between the light distribution element 23 and the light source recess 110.

In an alternative solution, the light source recess 110 has a recess wall 1102 extending in a vertical direction, and if the light source recess 110 matches the light source module 2 in size, all of the clamping holes 1101 may be arranged on the recess wall 1102 that surround the light source recess 110.

While in some examples, in addition to a drive unit 22, some other large-sized electrical components 4 may be additionally arranged in the ceiling lamp, for example, the electrical components 4 may be a connecting portion for introducing a power wire, a controller etc., and these electrical components 4 may be electrically connected with the drive unit 22. These electrical components 4 may also have a greater thickness, thus affecting the thickness of the ceiling lamp. In this case, a partition wall 1103 may be disposed in the light source recess 110, the partition wall 1103 is capable of dividing the light source recess 110 into a light source setting region 110*a* and an electrical component setting region 110*b*, the light source setting region 110*a* and the electrical component setting region 110*b* may be or may not be in communication with each other, and the clamping hole 1101 may be arranged on the recess wall 1102 and the partition wall 1103, which surround the light source setting region 110*a*.

One or more clamping holes 1101 may be arranged on each recess wall 1102 or the partition wall 1103 as required. The light source module 2 is disposed in the light source setting region 110*a*, and the electrical components 4 may be disposed in the electrical component setting region 110*b*. In this example, the light source recess 110 may extend from the middle of the partition 11 to the surrounding wall 10, thereby increasing the size of the electrical component setting region 110*b*.

Because the recess wall 1102 may be connected to both the recess bottom 1100 and a region of the partition 110 that does not protrude to form the light source region, the connection strength is higher. One side of the partition wall 1103 away from the recess bottom 1100 has no connection structures, and therefore the overall strength of the partition wall 1103 is lower. In particular, the position provided with the clamping holes 1101 is easier to break. In order to increase the structural strength of the partition wall 1103, in this example, a plurality of reinforcing blocks 1104 may be disposed on one side of the partition wall 1103 away from the light source setting region 110*a*, and a fixed connection is also adopted between the reinforcing blocks 1104 and the recess bottom 1100, and the partition wall 1103 is provided with a clamping hole 1101 for each reinforcing block 1104, that is, the clamping hole 1101 extends into the interior of the reinforcing block 1104, thereby improving the structural strength of the partition wall 1103.

To facilitate assembling of the light source module 2, in this example, a positioning hole 200 may be arranged on the substrate 20, and a positioning post 232, corresponding to the positioning hole 23, may be arranged on the light distribution element 23, and the substrate 20 and the light distribution element 23 are positioned through the cooperation of the positioning hole 200 with the positioning post 232.

In this example, in order to improve heat dissipation efficiency of the light source module 2, it is preferable that the substrate 20 and the recess bottom 1100 are in contact with each other. However, because the positioning post 232 needs to pass through the positioning hole 200, due to manufacturing tolerances and other factors, the positioning post 232 may protrude from the positioning hole 200 by a distance and extend beyond the substrate 20. At the same time, the second buckle 231 may also extend beyond the substrate 20, and the positioning post 232 and the second buckle 231 may hinder the contact/attaching of the substrate 20 with the recess bottom 1100, thus affecting the heat dissipation efficiency.

Therefore, the recess bottom 1100 may be provided with a positioning post avoidance region 1105 and a second buckle avoidance region 1106 respectively corresponding to the positioning post 232 and the second buckle 231. When the light source module 2 and the light source recess 110 are clamped, the positioning post 232 is received in the positioning post avoidance region 1105, and the second buckle 231 is received in the second buckle avoidance region 1106, so that the substrate 20 can be in contact with the recess bottom 1100.

Referring to FIG. 4, the light distribution element 23 provided by this example may also be provided with a boss 233 away from the substrate 20, the boss 233 is provided with a first through hole 2330, the substrate 20 is provided with a second through hole 201 corresponding to the first through hole 2330, the recess bottom 1100 is provided with an auxiliary mounting post 1107 corresponding to the second through hole 201, and the auxiliary mounting post 1107 passes through the second through hole 201 and abuts against the first through hole 2330. The auxiliary mounting post 1107 is provided with a first threaded hole 1107*a*.

Normally, the light source module 2 can be connected to the chassis 1 only through clamping structures, and in some special cases, for example when wear or damage of the clamping structures and the like occur, the light source module 2 may be further fixed to the chassis 1 through one first screw 26 passing through the first through hole 2330 and being threadedly connected to the first threaded hole 1107*a*.

In this example, the boss 233 may be disposed on the middle of the light source receiving cavity 24 and is surrounded by the light distribution structure 240, thereby making full use of the space of the light distribution element 23. Alternatively, in some examples, the middle of the light source receiving cavity 24 may protrude to form an auxiliary drive receiving cavity 27 surrounded by the light distribution structure 240 (referring to a second ceiling lamp shown in FIG. 6, a third ceiling lamp shown in FIG. 7 and a fourth ceiling lamp shown in FIG. 8), the auxiliary drive receiving cavity 27 may assist and cooperate with the drive receiving cavity 25 to receive part of the drive unit 22, which is also a solution that makes full use of the space of the light distribution element 23.

In summary, the ceiling lamp and the chassis provided by the examples of the present disclosure allow the overall thickness of the lamp body to be significantly reduced, thereby saving packaging and inventory costs.

The present disclosure provides a ceiling lamp and a chassis.

On the first aspect, examples of the present disclosure provide a ceiling lamp, which comprises a chassis and a light source module;

the chassis comprises a surrounding wall and a partition disposed within the surrounding wall, the partition divides a region surrounded by the surrounding wall into an assembly recess with a downward opening and a wiring recess with an upward opening;

part of the partition protrudes upwardly into the wiring recess and forms a light source recess with a downward opening and an upward recess bottom, and the light source module is provided in the light source recess.

Optionally, in the ceiling lamp, the light source recess and the light source module are in a clamping connection.

Optionally, in the ceiling lamp, the light source recess is provided with a clamping hole, the light source module is provided with a first buckle corresponding to the clamping hole, and the light source module is connected with the light source recess through a clamping connection of the first buckle with the clamping hole.

Optionally, in the ceiling lamp, the light source recess has a recess wall extending in a vertical direction, a partition wall is provided in the light source recess and the partition wall divides the light source recess into a light source setting region and an electrical component setting region, the light source setting region and the electrical component setting region are in or are not in communication with each other, and the clamping hole is provided on the recess wall and the partition wall, which surround the light source setting region.

Optionally, in the ceiling lamp, one side of the partition wall away from the light source setting region is provided with a plurality of reinforcing blocks, the reinforcing blocks are fixedly connected with the recess bottom, and the partition wall is provided with a clamping hole corresponding to each of the reinforcing blocks.

Optionally, in the ceiling lamp, the light source recess extends from a middle of the partition to the surrounding wall.

Optionally, in the ceiling lamp, the light source module comprises a substrate, a light emitting unit, a drive unit and a light distribution element;

the light distribution element is arranged on the substrate and covers the substrate, the light distribution element and the substrate are jointly surround to form a light source receiving cavity and a drive receiving cavity, the light emitting unit is arranged on the substrate and in the light source receiving cavity, and the drive unit is arranged on the substrate and in the drive receiving cavity; and the light distribution element is clamped with the light source recess.

Optionally, in the ceiling lamp, the light distribution element is provided with a second buckle, and the substrate is clamped with the second buckle.

Optionally, in the ceiling lamp, the substrate is provided with a positioning hole, the light distribution element is provided with a positioning post corresponding to the positioning hole, and the substrate and the light distribution element are positioned through a cooperation of the positioning hole with the positioning post.

Optionally, in the ceiling lamp, the recess bottom is provided with a positioning post avoidance region and a second buckle avoidance region respectively corresponding to the positioning post and the second buckle; and in a case that the light source module and the light source recess are in the clamping connection, the positioning post is received in the positioning post avoidance region, the second buckle is received in the second buckle avoidance region, so that the substrate is in contact with the recess bottom.

Optionally, in the ceiling lamp, the light distribution element is provided with a boss away from to the substrate, the boss is provided with a first through hole, the substrate is provided with a second through hole corresponding to the first through hole, the recess bottom is provided with an auxiliary mounting post corresponding to the second through hole, and the auxiliary mounting post passes through the second through hole and abuts against the first through hole; and the auxiliary mounting post is provided with a first threaded hole, and the light source module further comprises a first screw, the first screw passes through the first through hole and is in threaded connection with the first threaded hole.

Optionally, in the ceiling lamp, a surface of one side of the recess bottom away from the assembly recess is flush with an edge of the wiring recess.

Optionally, in the ceiling lamp, the ceiling lamp further comprises a cover, and the cover covers the assembly recess.

On the second aspect, examples of the present disclosure provide a chassis, which comprises a surrounding wall and a partition disposed within the surrounding wall, wherein the partition divides a region surrounded by the surrounding wall into an assembly recess with a downward opening and a wiring recess with an upwardly opening; and part of the partition protrudes upwardly into the wiring recess and forms a light source recess with a downward opening and an upward recess bottom.

Optionally, in the chassis, the light source recess is provided with a clamping hole.

Optionally, in the chassis, the light source recess has a recess wall extending in a vertical direction, a partition wall is provided in the light source recess and the partition wall divides the light source recess into a light source setting region and an electrical component setting region, the light source setting region and the electrical component setting region are in or are not in communication with each other, and the clamping hole is provided on the recess wall and the partition wall, which surround the light source setting region.

Optionally, in the chassis, one side of the partition wall away from the light source setting region is provided with a plurality of reinforcing blocks, the reinforcing blocks are fixedly connected with the recess bottom, and the partition wall is provided with a clamping hole corresponding to each of the reinforcing blocks.

Optionally, in the chassis, the light source recess extends from a middle of the partition to the surrounding wall.

Optionally, in the chassis, the recess bottom is provided with a positioning post avoidance region and a second buckle avoidance region.

Optionally, in the chassis, the recess bottom is provided with an auxiliary mounting post, and the auxiliary mounting post is provided with a first threaded hole.

Optionally, in the chassis, a surface of one side of the recess bottom away from the assembly recess is flush with an edge of the wiring recess.

In the ceiling lamp and the chassis provided by the examples of the present disclosure, the partition protrudes upwardly into the wiring recess to form the light source module, so as to arrange the light source module, so that the overall thickness of the ceiling lamp can be reduced significantly, thereby saving packaging and inventory costs.

The above examples of the present disclosure focus on differences between the various examples, and various optimization features in the various examples may be combined to form a more preferred example, so long as there is no conflict, in consideration of the simplicity of the text, it will not be repeated here.

The present disclosure may include dedicated hardware implementations such as disclosure specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above is only examples of the present disclosure and is not used to limit the present disclosure. For those skilled in the art, the disclosure may have various changes and modifications. Any modification, equivalent replacement, improvement, and the like made within the spirit and principles of the disclosure shall be included within the scope of the present disclosure.

The invention claimed is:

1. A ceiling lamp, comprising a chassis and a light source module, wherein:

the chassis comprises a surrounding wall and a partition disposed within the surrounding wall, the partition divides a region surrounded by the surrounding wall into an assembly recess with a downward opening and a wiring recess with an upward opening;

part of the partition protrudes upwardly into the wiring recess and forms a light source recess with a downward opening and an upward recess bottom, and the light source module is provided in the light source recess.

2. The ceiling lamp according to claim 1, wherein the light source recess and the light source module are in a clamping connection.

3. The ceiling lamp according to claim 2, wherein the light source recess is provided with a clamping hole, the light source module is provided with a first buckle corresponding to the clamping hole, and the light source module connects to the light source recess through a clamping connection of the first buckle with the clamping hole.

4. The ceiling lamp according to claim 3, wherein the light source recess has a recess wall extending in a vertical direction, a partition wall is provided in the light source recess and the partition wall divides the light source recess into a light source setting region and an electrical component setting region, and the clamping hole is provided on the recess wall and the partition wall, which surround the light source setting region.

5. The ceiling clamp according to claim 4, wherein one side of the partition wall away from the light source setting region is provided with a plurality of reinforcing blocks, the reinforcing blocks are fixedly connected with the recess bottom, and the partition wall is provided with a clamping hole corresponding to each of the reinforcing blocks.

6. The ceiling lamp according to claim 2, wherein:

the light source module comprises a substrate, a light emitting unit, a drive unit and a light distribution element;

the light distribution element is arranged on the substrate and covers the substrate, the light distribution element and the substrate are jointly surround to form a light source receiving cavity and a drive receiving cavity, the light emitting unit is arranged on the substrate and in the light source receiving cavity, and the drive unit is arranged on the substrate and in the drive receiving cavity; and the light distribution element is clamped with the light source recess.

7. The ceiling lamp according to claim 6, wherein the light distribution element is provided with a second buckle, and the substrate is clamped with the second buckle.

8. The ceiling lamp according to claim 7, wherein the substrate is provided with a positioning hole, the light distribution element is provided with a positioning post corresponding to the positioning hole, and the substrate and the light distribution element are positioned through a cooperation of the positioning hole with the positioning post.

9. The ceiling lamp according to claim 8, wherein:

the recess bottom is provided with a positioning post avoidance region and a second buckle avoidance region respectively corresponding to the positioning post and the second buckle; and in a case that the light source module and the light source recess are in the clamping connection, the positioning post is received in the positioning post avoidance region, the second buckle is received in the second buckle avoidance region, so that the substrate is in contact with the recess bottom.

10. The ceiling lamp according to claim 6, wherein:

the light distribution element is provided with a boss away from to the substrate, the boss is provided with a first through hole, the substrate is provided with a second through hole corresponding to the first through hole, the recess bottom is provided with an auxiliary mounting post corresponding to the second through hole, and the auxiliary mounting post passes through the second through hole and abuts against the first through hole; and the auxiliary mounting post is provided with a first threaded hole, and the light source module further comprises a first screw, the first screw passes through the first through hole and is in threaded connection with the first threaded hole.

11. The ceiling lamp according to claim 1, wherein a surface of one side of the recess bottom away from the assembly recess is flush with an edge of the wiring recess.

12. The ceiling lamp according to claim 1, further comprising a cover, wherein the cover covers the assembly recess.

13. A chassis, comprising a surrounding wall and a partition disposed within the surrounding wall, wherein:

the partition divides a region surrounded by the surrounding wall into an assembly recess with a downward opening and a wiring recess with an upwardly opening; and part of the partition protrudes upwardly into the wiring recess and forms a light source recess with a downward opening and an upward recess bottom.

14. The chassis according to claim 13, wherein the light source recess is provided with a clamping hole.

15. The chassis according to claim 14, wherein the light source recess has a recess wall extending in a vertical direction, a partition wall is provided in the light source recess and the partition wall divides the light source recess into a light source setting region and an electrical component setting region, the light source setting region and the electrical component setting region are in or are not in communication with each other, and the clamping hole is provided on the recess wall and the partition wall, which surround the light source setting region.

16. The chassis according to claim 15, wherein one side of the partition wall away from the light source setting region is provided with a plurality of reinforcing blocks, the reinforcing blocks are fixedly connected with the recess bottom, and the partition wall is provided with a clamping hole corresponding to each of the reinforcing blocks.

17. The chassis according to claim 13, wherein the light source recess extends from a middle of the partition to the surrounding wall.

18. The chassis according to claim 13, wherein the recess bottom is provided with a positioning post avoidance region and a second buckle avoidance region.

19. The chassis according to claim 13, wherein the recess bottom is provided with an auxiliary mounting post, and the auxiliary mounting post is provided with a first threaded hole.

20. The chassis according to claim 13, wherein a surface of one side of the recess bottom away from the assembly recess is flush with an edge of the wiring recess.

* * * * *